United States Patent [19]

Weisgerber et al.

[11] Patent Number: 4,972,771

[45] Date of Patent: Nov. 27, 1990

[54] FILM DAMPENER UNIT FOR OFFSET PRINTING PRESSES

[75] Inventors: Willi Weisgerber, Geisenheim-Johannisberg; Karl-Heinz Sellmann, Wiesbaden-Biebrich, both of Fed. Rep. of Germany; Guy V. Carricato, Pittsburgh, Pa.

[73] Assignee: Miller-Johannisberg Druckmaschinen GmbH, Wiesbaden-Biebrich, Fed. Rep. of Germany

[21] Appl. No.: 492,301

[22] Filed: Mar. 7, 1990

Related U.S. Application Data

[62] Division of Ser. No. 37,819, Apr. 13, 1987, abandoned.

[30] Foreign Application Priority Data

Jul. 12, 1986 [DE] Fed. Rep. of Germany ..... 3623590

[51] Int. Cl.[5] ..... B41F 7/26; B41F 7/36; B41F 7/40

[52] U.S. Cl. ..... 101/148; 101/352

[58] Field of Search ..... 101/148, 350, 364, 363, 101/349, 207, 208, 209, 210, 351, 352, DIG. 38

[56] References Cited

U.S. PATENT DOCUMENTS

| | | | |
|---|---|---|---|
| 173,085 | 2/1876 | Tucker | 101/DIG. 4 |
| 410,155 | 9/1889 | Dean | 101/350 |
| 2,138,779 | 11/1938 | Avery | 101/348 |
| 2,154,544 | 4/1939 | Taylor | 101/350 |
| 2,300,549 | 11/1942 | Huck | 101/DIG. 38 |
| 2,430,965 | 11/1947 | Taylor | 101/350 |
| 2,857,840 | 10/1958 | Bachman | 101/350 |
| 3,038,405 | 6/1962 | Wojclechowski | 101/148 |
| 3,094,065 | 6/1963 | Roberts | 101/148 |
| 3,283,741 | 11/1966 | Brodie | 101/350 |
| 3,343,484 | 9/1967 | Dahlgren | 101/350 |
| 3,448,686 | 6/1969 | Bohman | 101/349 |
| 3,467,008 | 9/1969 | Domotor | 101/350 |
| 3,536,006 | 10/1970 | Roozee | 101/148 |
| 3,563,173 | 2/1971 | Harless | 101/148 |
| 3,647,525 | 3/1972 | Dahlgren | 101/148 |
| 3,890,898 | 6/1975 | Fischer | 101/148 |
| 3,902,415 | 9/1975 | Fischer | 101/148 |
| 3,902,416 | 9/1975 | Cake | 101/148 |
| 3,902,417 | 9/1975 | Fischer | 101/148 |
| 3,986,452 | 10/1976 | Dahlgren | 101/148 |
| 4,290,363 | 9/1981 | Kobler | 101/DIG. 14 |

FOREIGN PATENT DOCUMENTS

| | | | |
|---|---|---|---|
| 3419764 | 11/1985 | Fed. Rep. of Germany | 101/349 |
| 415356 | 7/1910 | France | 101/349 |
| 154531 | 7/1932 | Switzerland | 101/348 |

*Primary Examiner*—J. Reed Fisher

*Attorney, Agent, or Firm*—Carothers & Carothers

[57] ABSTRACT

This invention concerns a film dampener unit for offset printing presses, with a dampening medium container in which a constant level of dampening medium is maintained, and with a dampener ductor of pan roller dipping into the dampening medium and transferring the dampening medium as a film onto at least one form roller which contacts the printing plate on the plate cylinder, whereby the thickness of the dampening medium film is determined by a metering roller which engages the dampener ductor roller surface in its rotary motion before the same engages the form roller. In order to reduce the number of rollers required for a flexibly operating dampener unit, the dampener ductor of this invention also functions as a dampener vibrator or oscillating ductor, having in addition to a rotation drive, another drive mehcanism which effects an axial back and forth or reciprocating movement.

20 Claims, 3 Drawing Sheets

FILM DAMPENER UNIT FOR OFFSET PRINTING PRESSES

This is a divisional of co-pending application Ser. No. 07/037,819 filed on 04/13/87, now abandoned.

BACKGROUND OF THE INVENTION

This invention concerns a film dampener for offset printing presses, with a dampening medium container in which a constant level of dampening medium is maintained and a dampener ductor roller which rotates to dip into the dampening medium and then transfer the dampening medium as a film onto at least one form roller which contacts the printing plate carried by the plate cylinder, the thickness of the dampening medium film being determined by a metering roller which engages the dampener ductor roller surface in its rotary motion before the same engages the form roller.

The offset printing process requires, as is well known, that the printing plate be constantly supplied with an accurately metered, even film of dampening medium.

In dampener units which work with lift or pickup roller metering, the lift roller and usually two form rollers with fabric covers (Molton covers) cooperate with intermediate rollers and vibrating rollers to fulfill this requirement as the absorbent roller covers form a large and relatively evenly distributed reservoir. However, this kind of dampener has the disadvantage that it hinders printing production because of long reaction time which results in a considerable number of waste sheets upon each press start-up after each planned or unplanned stop of the printing press. That is, the ink-dampening medium balance is lost during press down time and restoration of dampening medium balance takes a significant period of time after press startup.

Additionally, the fabric covers must be washed often and very carefully, thus requiring the lift and form roller to be frequently removed from the press and put into a special wash-up unit. The repeated removal and re-installation of the rollers requires considerable time. Furthermore, the fabric structure of the roller covers influences the printed image negatively as long as they are not compressed or compacted, and the covers must be replaced from time to time thus giving rise to further additional cost elements.

In order to avoid these and other disadvantages, many other systems of dampeners have been developed and marketed. Among such systems, one approach which has been successful is the use of a lifter-less or ductor-less dampener, also called a continuously working dampener unit or film dampener, which operates partly or completely without roller covers and mostly also with one form roller only.

These are mainly the so-called three or four roller dampeners, in which the form roller engages only the printing plate or, in other cases, the printing plate and the first vibrating roller of the inker unit, which makes the dampener form roller work simultaneously as an ink form roller. This last version has proven to be especially fast-reacting, which means that the ink-dampening medium balance is quickly restored after each stop of the press, and waste thus is minimal; however, the ink form roller is not completely effective in this arrangement, and this reduces the inking power of the inker which is especially adverse for high quality work.

Also in these dampeners without lifter or ductor, the dampener ductors or fountain rollers are driven generally by an adjustable speed electric motor which is adjustable independently of the press speed, and all participating rollers are, during the printing process, in constant contact, whereby even dampening medium distribution can be improved by circumferential lag or slip of the rollers contacting each other.

There are other inker-dampener combinations on the market which attempt to avoid the disadvantage of reduced inking power by using the #1 ink form roller also as a dampener form roller. In this case the dampener form roller is connected with the #1 ink form roller through a so-called bridge roller. This keeps the quick reaction of the previously mentioned systems, and the inking power of the inker is not lessened, but rather increased. Of course, the fast reaction is mainly due to the fact that an emulsion forms between incoming ink and simultaneously incoming dampening medium in the same contact locations, which is so important for offset printing.

The contact between ink and dampening medium is made in each instance before the first print is made, i.e. before the ink and dampening form rollers are turned on. Therefore, the printing plate receives the correct emulsion immediately, and this results in good quality prints from the very first impression.

Altogether it can be said that many dampener unit designs, especially film dampeners, work more or less satisfactorily. But the demands on dampener units for offset printing presses depend on the print forms, materials, inks, dampening media, inker unit arrangements, and so forth, as well as on a number of other parameters, e.g. printing speed dampening medium evaporation rate, use of dampening medium with or without added alcohol, and many others. With these limitations the range of application possibilities is more or less restricted for most known film dampener units.

BRIEF SUMMARY OF THE INVENTION

The invention alleviates these and other disadvantages of the prior art by the dampener ductor or fountain roller being simultaneously formed for use as a dampener vibrating ductor by having not only a rotary drive but also a reciprocating axial drive mechanism, contrary to all known designs of dampener units, in which it would have a rotary drive only. For metering and other adaption reasons it is recommended that the dampener vibrating ductor be driven independently of the press with freely selected speed. However, the invention provides further adaption possibilities by having the axial stroke magnitude of the dampener vibrator ductor being randomly adjustable in respect to the plate cylinder rotation, and/or by the axial stroke number or rate of the dampener ductor being randomly adjustable, also in respect to the plate cylinder rotation.

Practical use has shown that such a film dampener can be easily adapted to a wide range of requirements and parameters, and that its application range is correspondingly varied. Since the dampener vibrator ductor takes over an additional task, that is, the work of a vibrating roller, the design cost of the dampener unit compared with known structures, is not only not higher but in fact is reduced. The form roller can be driven in force-locked relation by the press at the same circumferential or surface speed (rotary speed) as the printing plate, and can be finely adjustable towards the dampener ductor, as well as towards the printing plate. The form roller can also be driven by the press at a lower speed than that of the printing plate, so that a predetermined slip occurs between the form roller and the printing plate. The form roller can also be driven by the press with variable rotation speed in such a way that it is possible to set a selected plus or minus range of deviation from the speed at which it is synchronized with the printing plate.

The dampener vibrator or oscillating ductor can have a hard, metallic surface such as chrome-plating or non-corroding steel, or a fully elastic surface such as a rubber cover on a steel spindle or core.

According to a further characteristic of the invention, the metering roller can be connected to the dampener ductor through a force-locked drive, and can be driven either at the same or a higher circumferential or rotary speed than the dampener ductor. In this last mentioned case a circumferential slip results between the metering roller and the dampener ductor to thereby provide a positive influence on dampening medium distribution.

In the dampener unit as per this invention, it is possible to provide two dampening medium slip gaps on the dampener ductor, one between the dampening ductor and the metering roller, and the second between the dampening ductor and the form roller. This provides for the finest metering of the dampening medium flow or dampening film with the shortest film travel to the printing plate, so that evaporation of the dampening medium is negligible.

In a further elaboration of the invention, a bridge roller with a hard surface can be arranged between the dampening medium form roller and the first ink form roller of the neighboring inker. This bridge roller can be finely adjusted radially towards the dampening medium form roller and also can be swivelled around it to the first ink form roller. The bridge roller also can be driven force-locked by the dampening medium form roller with the same circumferential or rotary speed as this roller, and can be reciprocated axially by means of a gear linkage and drive rod assembly. In the start-up phase of the printing press, the bridge roller can be brought into contact simultaneously with the dampening medium form roll and the ink form roll, while it can contact in other modes only one of these two rollers. The reason for this is that it may be advantageous for some work to combine application of ink and dampening medium while other work may be better printed with separate ink and dampening medium supply.

The invention will be more readily understood upon consideration of the following detailed description and the accompanying drawings, in which.

Figure 1:
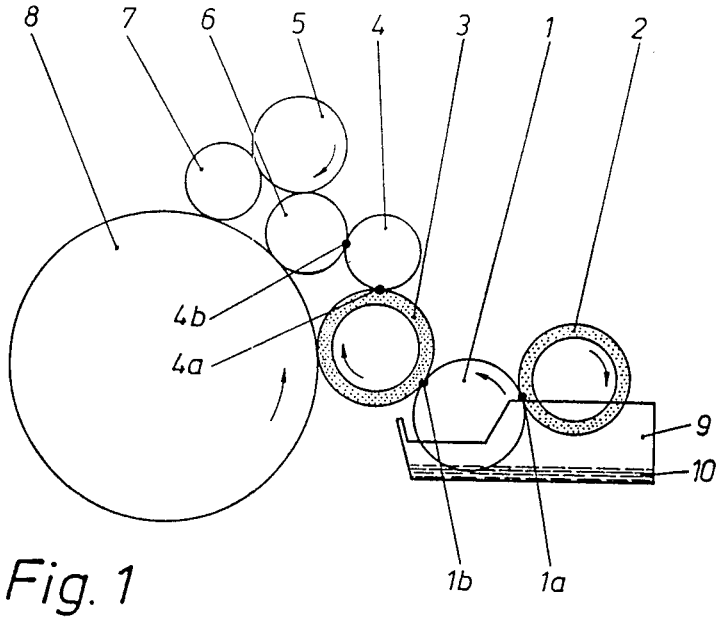
FIG. 1 is a schematic side elevation of the film dampener according to the present invention.

In a film dampener as depicted in FIG. 1, dampening liquid 10 is transferred from a dampening medium container 9 to a dampener vibrating oscillating ductor 1 and distributed over a dampening medium form roller 3 by rolling contact therewith and then directly from form roller 3 onto a printing plate (not shown) carried by a plate cylinder 8. The thickness of the dampening medium film or roller 1 is set according to job requirements by means of a metering roller 2 at the contact location 1*a*. Container 9 may be provided with a suitable cover 9*a* (FIG. 2) to prevent splashing of contained medium 10 in response to movement of roller 1 therein.

Figure 2:
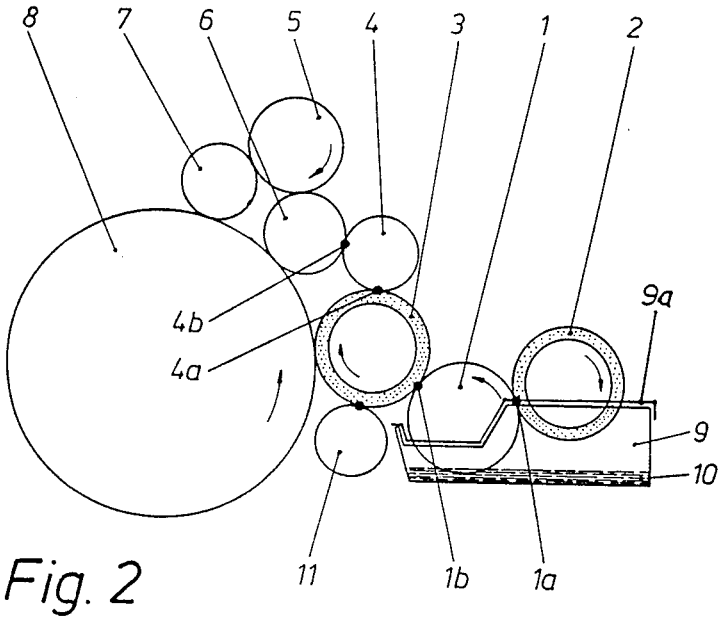
FIG. 2 is a film dampener similar to that shown in FIG. 1, but with an additional, driven dampener vibrator roller.

The film dampener according to FIG. 2 is distinguished from FIG. 1 only in that a dampener vibrator roller 11, which can be driven at an independently adjustable speed, is located to contact dampening medium form roller 3 between dampener vibrating ductor 1 and plate cylinder 8. Dampening medium form roller 3 engages both of ductor 1 and bridge roller 4, and both of these may reciprocate axially during contact with roller 3.

Figure 3:
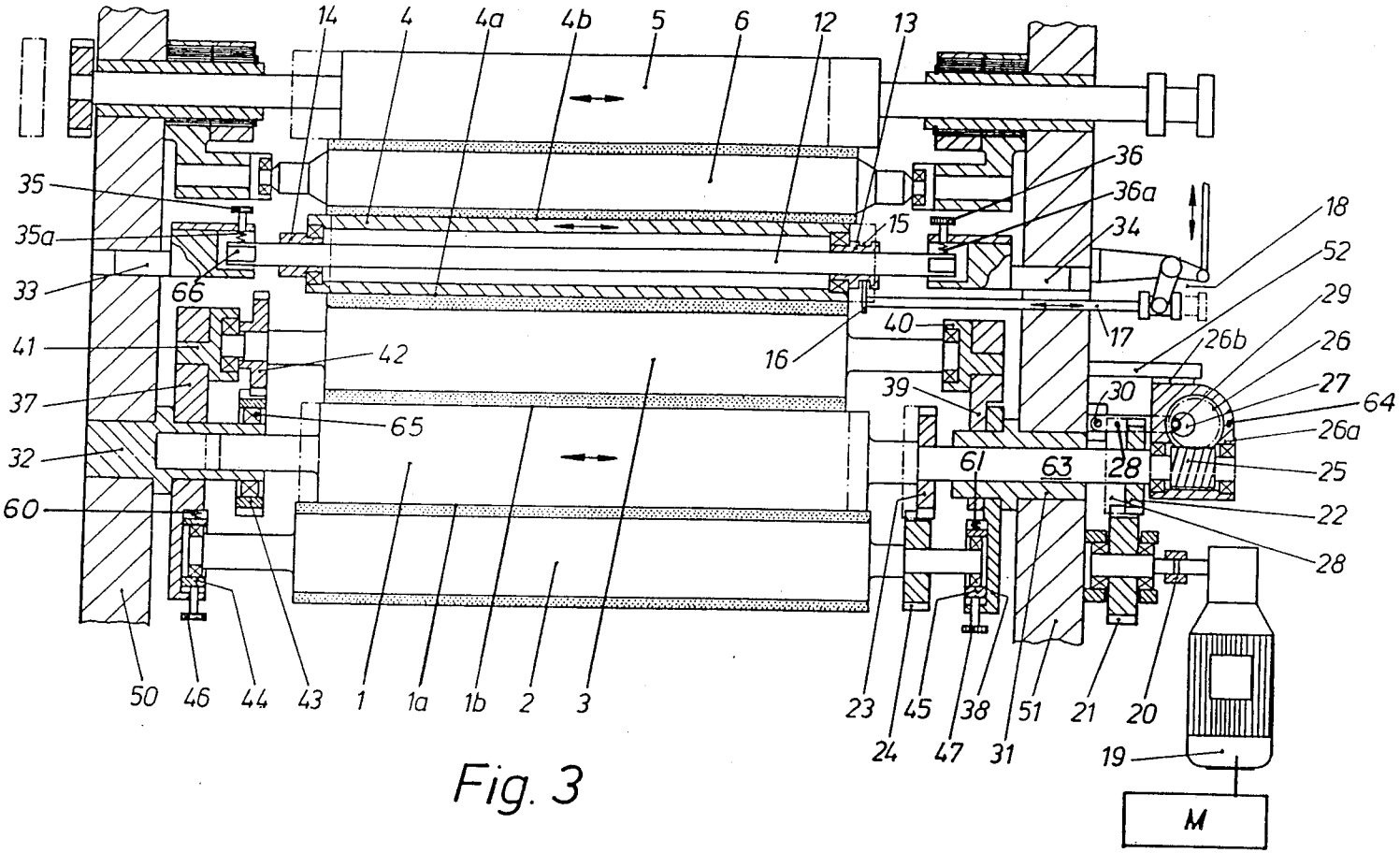
FIG. 3 is a top plan view, partially sectioned, of the film dampener unit of the invention.

As shown in FIG. 3, metering gap 1*a* is set against springs 60 and 61 by respective adjustment screws 46 and 47 through slide bearings 44 and 45, in which metering roller 2 is supported. The slide bearings 44 and 45 are held in guides which are carried, respectively, in double-arm lever 37 and one-arm lever 38. The double-arm lever 37 is concentrically supported on one flange bearing 32, in which dampener ductor 1 is also supported. By means of the one-armed lever 38, which is also concentrically supported on the axially opposed flange bearing 31, the metering roller can be axially skewed to the dampener ductor 1 by a suitable adjustment mechanism (not shown).

Dampener ductor 1 and metering roller 2 are driven independently of the press drive with a separate, adjustable-speed gear motor 19 through a clutch 20, a drive gear 21 and a mating driven gear 22 which is fixedly located on the journal 63 of dampener ductor 1. Another gear 23 non-rotatably mounted on journal 63 drives the metering roller 2 through a mating gear 24. The drive ratio of gears 23 and 24 is chosen according to the desired ratio and relationship of the rotary speed of respective rollers 1 and 2; i.e. synchronous or asynchronous rotation.

Adjacent the outermost end of journal 63 of dampener ductor 1 is a reciprocating drive such as a Krebs gear unit wherein a worm 25 in driving engagement with a worm gear 26 is supported in a housing 64. Worm gear 26 is provided with an eccentric bore in which is received an eccentric pin 27. An eccentric 29 on pin 27 is of the same eccentricity as the bore in worm gear 26. A strap or link 28 forms a connection between eccentric stud 29 and a pin 30 which is mounted in the press side frame 51 to provide, during operation of the press, the axial reciprocating motion of dampener ductor 1. Specifically, housing 64 is carried with respect to the press by receiving the outermost end of journal 63 therein in rotary bearings and in rotary driving engagement with worm 25 being mounted for movement longitudinally of an elongated guide pin 52 that is rigidly affixed to and projects outwardly of the press side frame 51. As roller 1 is driven in rotation, the consequent rotation of worm 25 drives worm gear 26 in rotation. Stud 29 thus orbits about the center of worm gear 26, at a diameter depending upon the adjusted position of pin 27 within the bore as below described. Because stud 29 is pivotally affixed to link 28, which in turn is pinned with respect to side frame 51 by pin 30, the orbiting movement of stud 29 about the center of worm gear 26 moves housing 64 to and fro along guide pin 52 thus driving the journal 63, and consequently the entire roller 1, in axial reciprication.

Gear motor 19 may be an adjustable speed motor to provide for varying of the reciprocal stroke rate of roller 1, and may additionally be connected through a suitable electronic control module M to the printing press drive (not shown) to thereby provide speed compensation with respect to the press drive.

The eccentric pin 27 can be rotated by 180° locked in any selected position thereof within the eccentric bore of worm gear 26, so that the position of the eccentric stud 29 can be adjusted from a minimum eccentricity with respect to gear 26, to a maximum eccentricity. Preferably, the minimum eccentricity may be nil, thus providing as a minimum no axial oscillation of dampener ductor 1.

The adjustability of eccentric pin 27 as described thus makes it possible to adjust the reciprocation or oscillation stroke of roller 1 within a continuous range from nil to a maximum. The housing 26*a* is suitably secured to guide pin 52 so as to be secured against all motion except movement axially thereof.

One journal end of dampening medium form roller 3 is supported in an eccentric bearing 41 carried by double-armed lever 37, and the other journal end is supported in an eccentric bearing 40 in the one-armed lever 39. Levers 37 and 39 are supported concentrically on the respective dampener ductor flange bearings 32 and 31.

The dampener form roller 3 is positioned with respect to the dampener ductor 1 by adjustment of eccentric bearings 40 and 41. The means necessary for this adjustment are well known and detailed description thereof is believed unnecessary for an understanding of the invention.

The double-armed lever 37 and the one-armed lever 39, (which itself forms a unit with the one-armed lever 38 after the fine adjustments) can be precisely adjusted with respect to the printing plate on plate cylinder 8 by rotary movement of levers 37 and 39 about the center axis of the dampener ductor 1.

A gear 42 is fixed to one journal of the dampening medium form roller 3 for driving engagement with an intermediate gear 43 which is rotatably supported in rotary bearings 65 on flange bearing 32 of dampener ductor 1. The press drive (not shown) engages gear 43 for rotary driving thereof. The surface or rotary speed of the dampening medium form roller 3 is either synchronous with that of the plate cylinder 8, or asynchronous therewith, if the ratio has been changed.

The bridge roller 4 has its end journals received in eccentric bearings 33 and 34 between dampening medium form roller 3 and ink form roller 6. Bridge roller 4 is carried coaxially on a rotationally fixed spindle 12 by respective right and left end slide bearings 13 and 14, on each of which a rotary ball bearing is located. The slide bearings 13 and 14 are locked against turning on spindle 12 by means of a profiled guide, e.g. splines, not shown. The spindle 12 itself is locked against turning in the eccentric bearings 33 and 34 by such means as suitable flats 66. The contact force of bridge roller 4 on rollers 3 and 6 is adjustable with adjusting screws 35 and 36 against respective springs 35*a* and 36*a*. The bridge roller 4 may be rotationally driven in force-locked relation with the form roller 13 and the same rotary speed.

The bridge roller 4 is moved axially back and forth by a slide drive 18 and a reciprocating slide rod 17 through a sliding fork 16 which engages a recess 15 in slide bearing 13. Bridge roller 4 thus is driven in endwise or axial reciprocation in operation while it rotates freely in contact with rollers 3 and 6.

Figure 4:
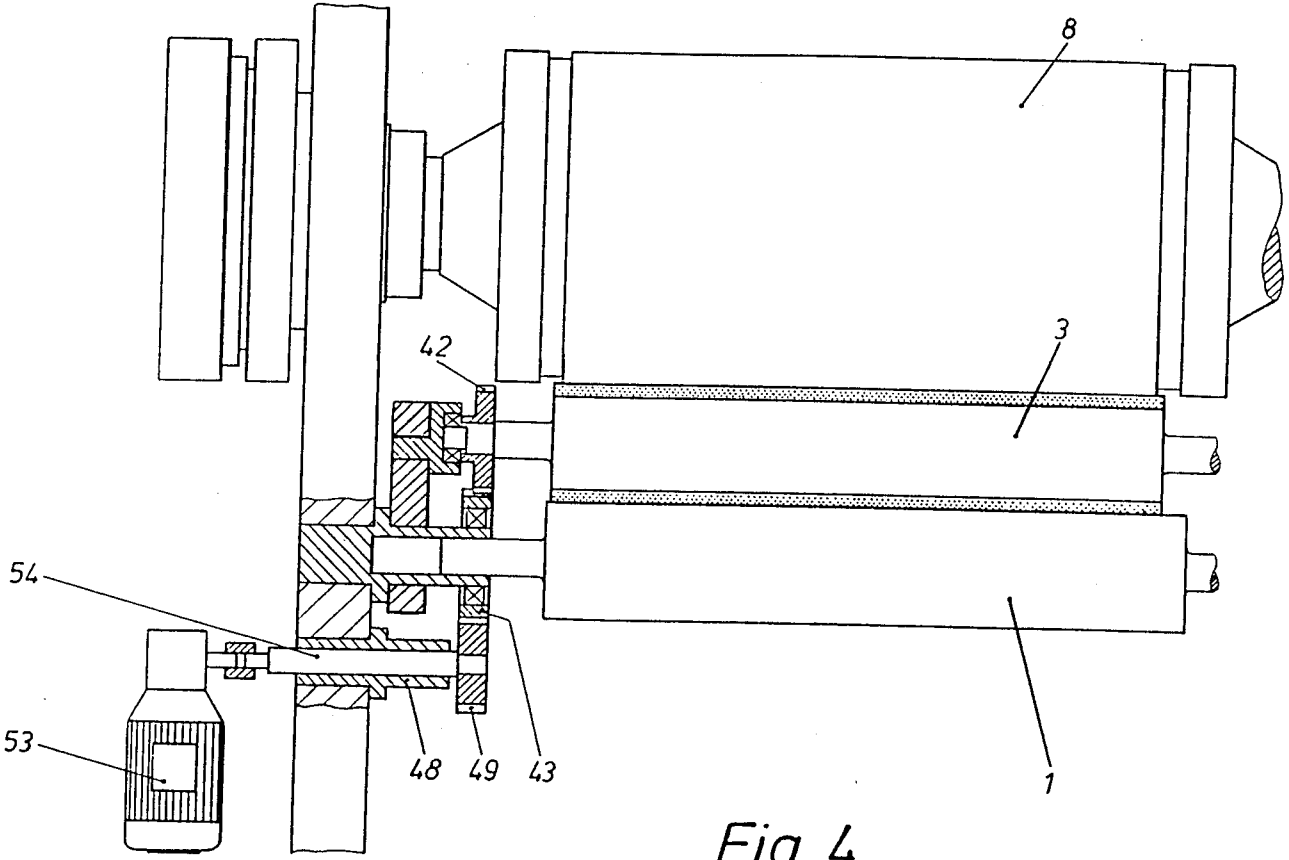
FIG. 4 is a drive arrangement for the dampening medium form roller of the invention.

FIG. 4 shows the dampening medium form roller drive, when the dampening medium form roller 3 is not driven by the press but independently from it. Specifically, an adjustable gear motor 53 drives the dampening medium roller 3 via a clutch and shaft assembly 54 which is supported in a bearing bushing 48 and includes a drive gear 49 which engages the above described intermediate gear 43 to drive the gear 42, and thus the roller 3, in rotation. Of course, roller 1 may be driven independently of the press drive in the same manner.

It will be understood that the above description of the presently contemplated best mode of the invention is intended to be exemplary in nature and not to limit the scope of the invention. Indeed, we have contemplated various alternative and modified embodiments other than those above described, and such certainly would also occur to others versed in the art, once apprised of our invention. Accordingly, it is our intent that the invention be construed as broadly as permitted by the scope of the claims appended hereto.

We claim:

1. In a film dampener unit cooperably associated with an offset printing press said offset press having a plate cylinder and a drive for driving said plate cylinder at a rotary speed, said dampener unit having a dampening medium container which contains a quantity of dampening medium and an axially rotatable dampener fountain roller which is carried by a frame for movement during said axial rotation thereof to a dipping position whereat an external cylindrical surface of said dampener fountain roller dips into said dampening medium in said container during axial rotation of said dampener fountain roller and said dampener fountain roller being further movable from said dipping position into engagement with a form roller which contacts a printing plate mounted on said plate cylinder for transferring a film of dampening medium from said dampener fountain roller onto said form roller, and said film dampener unit further having a metering roller which contacts said dampener fountain roller to regulate the thickness of said dampening medium film, said metering roller contacting said dampener fountain roller during axial rotation thereof after said dampener fountain roller has dipped into said dampening medium and before said dampener fountain roller contacts said form roller, and wherein said dampener fountain roller further is movable in axial reciprocation and a drive mechanism is operatively connected to said dampener fountain roller to impart axial reciprocating movement thereto, and said film dampener unit further having a bridge roller with a hard surface, said bridge roller being arranged between said form roller and a first ink form roller of a cooperable inker unit, means for adjusting said bridge roller for movement radially toward said form roller and swivellably around said form roller toward said first ink form roller, the improvement comprising:

a dampener vibrator roller driven by a drive means at an adjustable speed in contact with said form roller means for driving said dampener vibrator roller in axial reciprocation in response to movement of said dampener fountain roller and said bridge roller.

2. The improvement as claimed in claim 1 wherein said form roller (3) contacts three contact rollers, including said dampener fountain roller (1), said bridge roller, and said dampener vibrator roller whereby all three of said contact rollers provide an axial distribution of the dampening medium, the strokes and reversal points of said contact rollers being adjustable to provide offset of said contact rollers with respect to each other.

3. The improvement as claimed in claim 1 wherein said drive mechanism includes means for adjusting the stroke length of said axial reciprocating movement of said dampener fountain roller with respect to the rotary speed of said plate cylinder.

4. The improvement as claimed in claim 3 including adjustment means for adjusting the stroke rate of said axial reciprocating movement of said dampener fountain roller with respect to the rotary speed of said plate cylinder.

5. The improvement as claimed in claim 4 including means adapted for driving said form roller (3) in force-locked relation with a drive for said offset printing press and means for adjusting the position of said form roller (3) with respect to said dampener fountain roller (1) and said plate cylinder to permit selectively moving said form roller (3) toward or away from said dampener fountain roller (1) and said plate cylinder.

6. The improvement as claimed in claim 4 additionally including a variable speed form roller drive connected to said form roller and operable to permit said form roller to be driven at a variable rotary speed in a manner that deviation thereof from synchronized rotary motion with respect to said plate cylinder within a given range may be selectively established by varying the speed of said form roller drive.

7. The improvement as claimed in claim 4 including means for driving said form roller at the same rotary speed as that of said plate cylinder.

8. The improvement as claimed in claim 6 wherein said form roller (3) is driven at a lower rotary speed than said plate cylinder.

9. The improvement as claimed in claim 1 wherein said external cylinder surface of said dampener fountain roller (1) is a hard, metallic surface.

10. The improvement as claimed in claim 9 wherein said form roller includes an elastic cover which encloses a rigid spindle.

11. The improvement as claimed in claim 3 wherein said drive mechanism is a gear drive unit having a worm which is drivingly engaged by said dampener fountain roller and a worm gear which engages said worm, and an eccentric pin which is carried by said worm gear and includes an eccentric stud that receives a link which is connected by hinge means to said frame, said eccentric pin being adjustable with respect to said worm gear in a manner to vary the reciprocal stroke length of said dampener fountain roller.

12. The improvement as claimed in claim 4 wherein said drive mechanism includes an adjustable speed motor and a gear unit connected in driving engagement with said dampener fountain roller and in driven engagement with said adjustable speed motor whereby the relative stroke rate of said axial reciprocating movement is adjustable and wherein said drive mechanism further includes an electronic control means which is operatively connected to said adjustable speed motor to regulate the speed of said adjustable speed motor with respect to the speed of said drive for said offset printing press.

13. The improvement as claimed in claim 1 wherein said metering roller (2) is connected by a force-locked drive means with said dampener fountain roller (1).

14. The improvement as claimed in claim 13 wherein said force-locked drive means drives said metering roller (2) at a higher rotary speed than the speed of said dampener fountain roller (1).

15. The improvement as claimed in claim 1 wherein two dampening medium metering gaps (1*a*, 1*b*) are provided for said dampener fountain roller (1) in the complete dampening medium flow, one between said dampener fountain roller (1) and said metering roller (2) and the other between said dampener fountain roller (1) and said form roller (3).

16. The improvement as claimed in claim 1 including means for supporting said metering roller (2) for skewed engagement against said dampener fountain roller (1) and for finely adjusting the skew of said metering roller with respect to said dampener fountain roller (1).

17. The improvement as claimed in claim 3 wherein said dampener fountain roller has a minimum and a maximum axial stroke length and said dampener fountain roller is longer than said form roller by an increment equal to the difference between said minimum and maximum axial stroke lengths plus at least 20 mm., and said form roller is itself longer than the width of said plate on said plate cylinder.

18. The improvement as claimed in claim 17 wherein said metering roller is longer than said dampener fountain roller by said increment.

19. The improvement as claimed in claim 2 wherein said bridge roller (4) is connected by a force-locked drive means to said form roller (3) for rotary driving thereof at the same circumferential speed as said form roller (3) and is axially reciprocable by means of a stroke gear linkage.

20. The improvement as claimed in claim 19 including means for moving said bridge roller (4) in axial reciprocation while said bridge roller (4) simultaneously contacts said form roller (3) and said first ink form roller (6) only in a press start-up phase of printing press operation, and outside of said press start-up phase of operation said bridge roller (4) contacts either said form roller (3) only, or said first ink form roller (6) only.

* * * * *